United States Patent [19]

Springer

[11] 4,030,412

[45] June 21, 1977

[54] DUPLICATING MACHINE

[75] Inventor: Edward M. Springer, Chicago, Ill.

[73] Assignee: Heyer Inc., Chicago, Ill.

[22] Filed: Apr. 7, 1976

[21] Appl. No.: 674,367

[52] U.S. Cl. ..... 101/132; 101/235

[51] Int. Cl.[2] ..... B41L 11/08

[58] Field of Search ..... 101/132, 132.5, 136, 101/233, 234, 235, 236, 245, 141, 142, 144

[56] References Cited

UNITED STATES PATENTS

| | | | |
|---|---|---|---|
| 2,216,593 | 10/1940 | Marchel et al. | 101/245 X |
| 2,975,707 | 3/1961 | Springer | 101/132 X |
| 3,037,447 | 6/1962 | Gonzalez et al. | 101/235 X |
| 3,795,190 | 3/1974 | Wallace | 101/233 |

*Primary Examiner*—J. Reed Fisher

*Attorney, Agent, or Firm*—McCaleb, Lucas & Brugman

[57] ABSTRACT

A duplicating machine has an impression roll positioned to press copy sheets against a master sheet on a drum which is rotatable by an electric drive motor through a coil spring type clutch. The clutch consists of a coil spring having an interference fit with cylindrical friction surfaces on driving and driven clutch members which are connected respectively to the motor and drum. The coil spring is helically wound in a direction to tighten the interference fit when the motor rotates the driving clutch member to turn the drum in a printing direction; conversely, the interference fit loosens when the driving end of the coil spring is held, enabling the driving clutch member to rotate freely. A tang on the driving end of the spring is positively connected to a cylindrical release collar surrounding the spring. The driven end of the spring has a positive tang connection to the driven clutch member and drum. Thus, rotation of the release collar and drum are synchronized within a range determined by the torsional elasticity of the spring. A stop arm is movable to and from a stop position engaging one or more detent recesses in the release collar. Engagement of the stop arm within one of the recesses, at the end of a printing run, automatically stops the collar. This disengages the clutch by releasing the interference fit between the spring and the driving clutch member. The drum stops at a position determined by the stopped position of the release collar. A plurality of detent recesses are circumferentially and axially spaced about and along the axis of the release collar. The stop arm is selectively engageable with one or the other of the recesses to stop the drum at different rotated positions to enable the ends of different length master sheets to clear the impression roll. A manually operable starter arm assembly releases the stop arm from the detent recess on the release collar and simultaneously closes a switch to actuate the drive motor. Conversely, when the last copy sheet is fed into the machine, the stop arm automatically drops into the selected recess to stop the release collar to disengage the clutch while simultaneously opening the switch to deactuate the driving motor and allow the drive train to coast to a stop.

16 Claims, 19 Drawing Figures

190
252
254b
276
280
256
188
280
A
196
194
200
69
202
26
198
192
54
202
184
182
180
186
190
188
208
254b
256
210
28
258
252
248
246
250
206
280
254a
260
282
276
278
10
262
272
286
212
202
292
8
289
288
271
268
270
284
8
214
266
264
216
218
332
336
9
9
212
222b
222
226
228

Fig. 7.
(SHEMATIC)
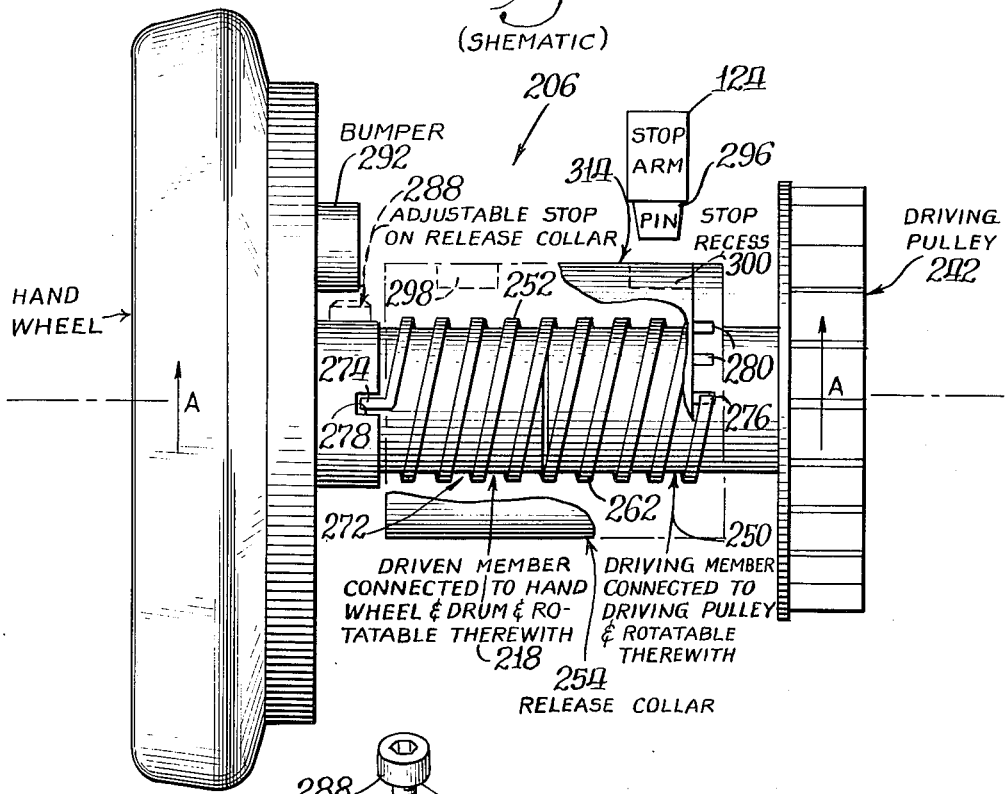
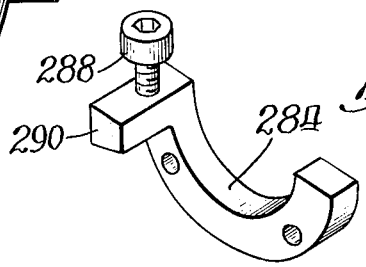
Fig. 11.
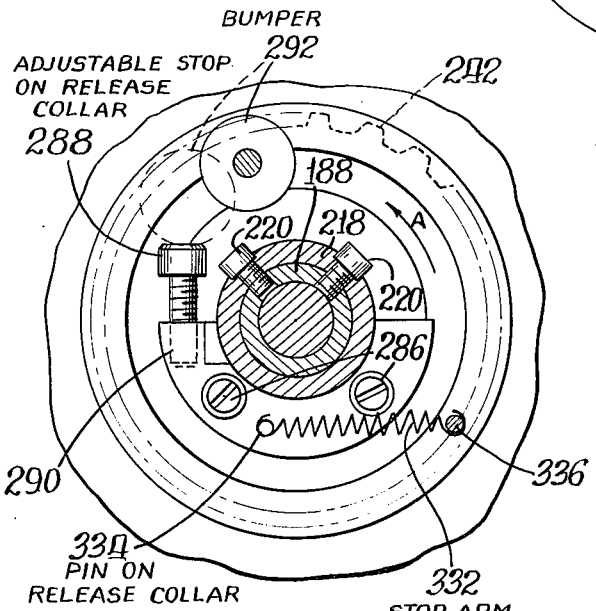
Fig. 8.
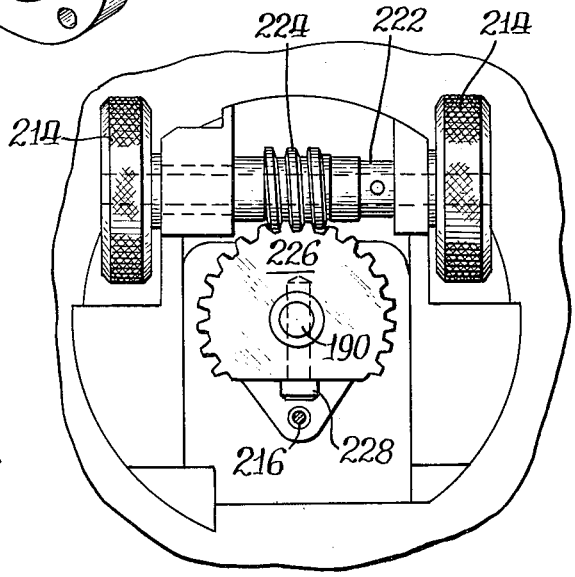
Fig. 9.

328
306
322
330
320
324
304
323
312
324a
324b
326
148
124
25b
25
280
25a
A
288
282
176
290
316
332
286
300
298
296
334
314
284
336
286

DUPLICATING MACHINE

BACKGROUND OF THE INVENTION

The field of the invention is generally that of a duplicating machine in which a master sheet is carried on a drum and an impression roll presses copy sheets against the master sheet as the drum is rotated. In the use of the machine, the copy sheets are stacked on a feed table at the inlet of the machine and are fed from it successively to the drum in synchronism with rotation of the drum, one sheet being fed during each revolution of the drum.

When the last copy sheet is fed from the stack, the machine stops. It is important when it stops that the end of the master sheet is beyond, and free of, the impression roll. Otherwise, if the drum remains stopped for any length of time with the master sheet pressed against the drum, the master sheet will have a flaw under the impression roll and this will show on subsequent copies made from that master.

The head or leading end of the master sheet is held by a clamp bar in an axially extending groove formed in the drum with the end of the master sheet beyond the impression roll as described above, the clamp bar should be readily accessible to facilitate changing the master sheet.

Thus, two things are important when the drum automatically stops at the end of a printing run:

1. The end of the master sheet should be beyond the impression roll in case the master sheet is to be reused; and
2. The clamp bar should be accessible, at least for the 11" master sheets most commonly used, in case the master sheet is to be changed.

BRIEF SUMMARY OF THE INVENTION

A general object of the present invention is to provide a simple, reliable, and inexpensive duplicating machine mechanism for automatically stopping the drum with the end of the master sheet beyond the impression roll.

Another object is to provide such a duplicating machine mechanism which is selective for use with different length master sheets.

Another object is to provide such a duplicating machine mechanism in which initiation of the printing operation automatically actuates the drum drive motor while simultaneously engaging a clutch between the motor and drum; and feeding of the last copy sheet into the machine at the end of the printing operation automatically deactuates the drive motor and releases the clutch.

Another object is to provide a duplicating machine in which the motor drives the drum through a coil spring type clutch having a release collar connected through a coil spring clutch member to the drum so that rotation, and stopping, of the drum is synchronized with that of the release collar within the torsional elasticity of the spring.

Another object is to provide a duplicating machine with such a coil spring type clutch controlled by a stop arm engageable with detent recess means in the release collar, to automatically stop the release collar when the last copy sheet has been fed into the machine, thereby releasing the clutch and stopping the drum at a position determined by the stopped position of the release collar.

Another object is to provide such a release collar with a plurality of circumferentially spaced detent recess means on the release collar, and adjustment means for selectively aligning the stop arm with a selected one of the detent recess means for stopping the drum at different rotated positions for different length master sheets.

Another object is to provide a cylindrical guide surface on the release which is automatically engageable by the stop arm in advance of engaging the detent recess means, and spring biasing means to counteract frictional drag of the stop arm on the guide surface.

Another object is to provide, in a duplicating machine having the drum connected through a torsion spring to such a release collar, adjustable bumper means limiting rotational overrun of the drum relative to the release collr, when the latter is stopped, to an extent within the torsional elasticity of the spring.

Another object is to provide a duplicating machine with such a coil spring type clutch connected between the release collar and drum, in which a tang at one end of the spring is held in one of a series of circumferentially spaced, optional, grooves to provide an adjustment between the relative rotated positions of the release collr and drum.

Another object is to provide a duplicating machine in which drive from the motor to the drum is controlled by a coil spring type clutch having interference fit with driving and driven members connected to the motor and drum respectively, and the opposite ends of the clutch are connected respectively to the collar and to the driven member enabling the clutch to synchronize the rotated position of the driven member and drum with that of the release collar within limits determined by the torsional elasticity of the spring.

Other, more specific, objects are to provide detent recesses which are both circumferentially and axially spaced in a cylindrical surface on the release collar, and a stop arm selectively axially movable along that cylindrical surface to align it with a selected one of the recesses to stop the collar and drum according to the detent recess selected.

BRIEF DESCRIPTION OF THE DRAWINGS

Other objects and advantages will be apparent from the following description taken in connection with the drawings in which:

FIG. 6 is an enlarged fragmentary cross sectional view of the machine taken along the axis of the hand wheel and drum showing the major components rotatable with the drum;

FIG. 7 is a simplified schematic view of FIG. 6 illustrating the construction and principle of operation of the clutch assembly and associated components;

FIGS. 8, 9 and 10 are cross sectional views of FIG. 6 taken along lines 8—8, 9—9 and 10—10 respectively;

FIG. 11 is a perspective view of an adjustable bumper component;

Like parts are referred to by like reference characters throughout the drawings.

DETAILED DESCRIPITON OF THE PREFERRED EMBODIMENT

The present invention may be applied to a wide variety of duplicating and printing machines in which a motor drives a printing drum through a clutch. It is here illustrated and described as applied to a spirit type duplicator using a hectographic master sheet but could usefully be applied to ink type duplicators in which the master sheet is a stencil.

First, by way of background, the construction and operation of the duplicating machine illustrated will be described in a general way with reference to the overall arrangement shown in FIGS. 1 and 17. The applicant has several prior patents on various portions of the machine illustrated. Reference will be made to certain of those patents to avoid repeating here descriptions of known mechanisms shown in prior patents.

Figure 1:
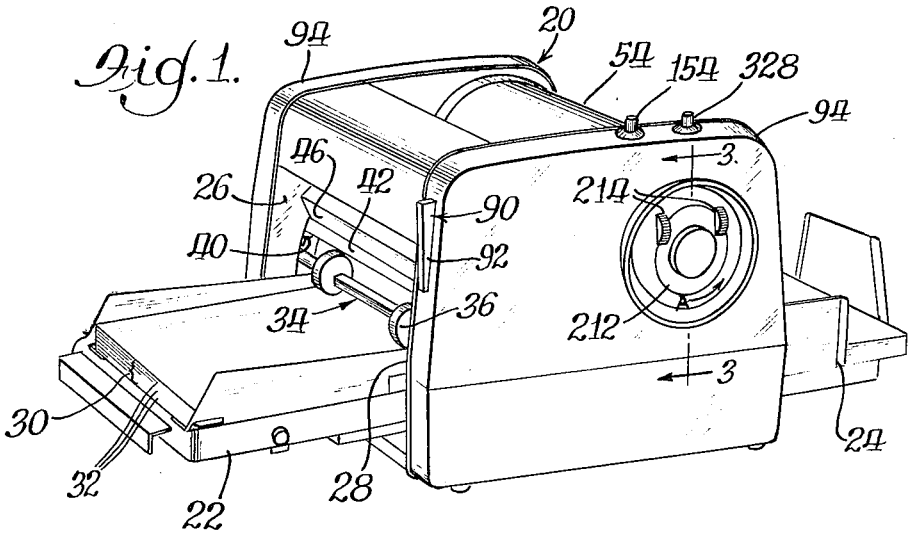
FIG. 1 is a perspective view of a machine which illustrates the present invention, the figure showing side ornamental and safety cover plates which enclose certain operative parts of the machine.
Figure 17:
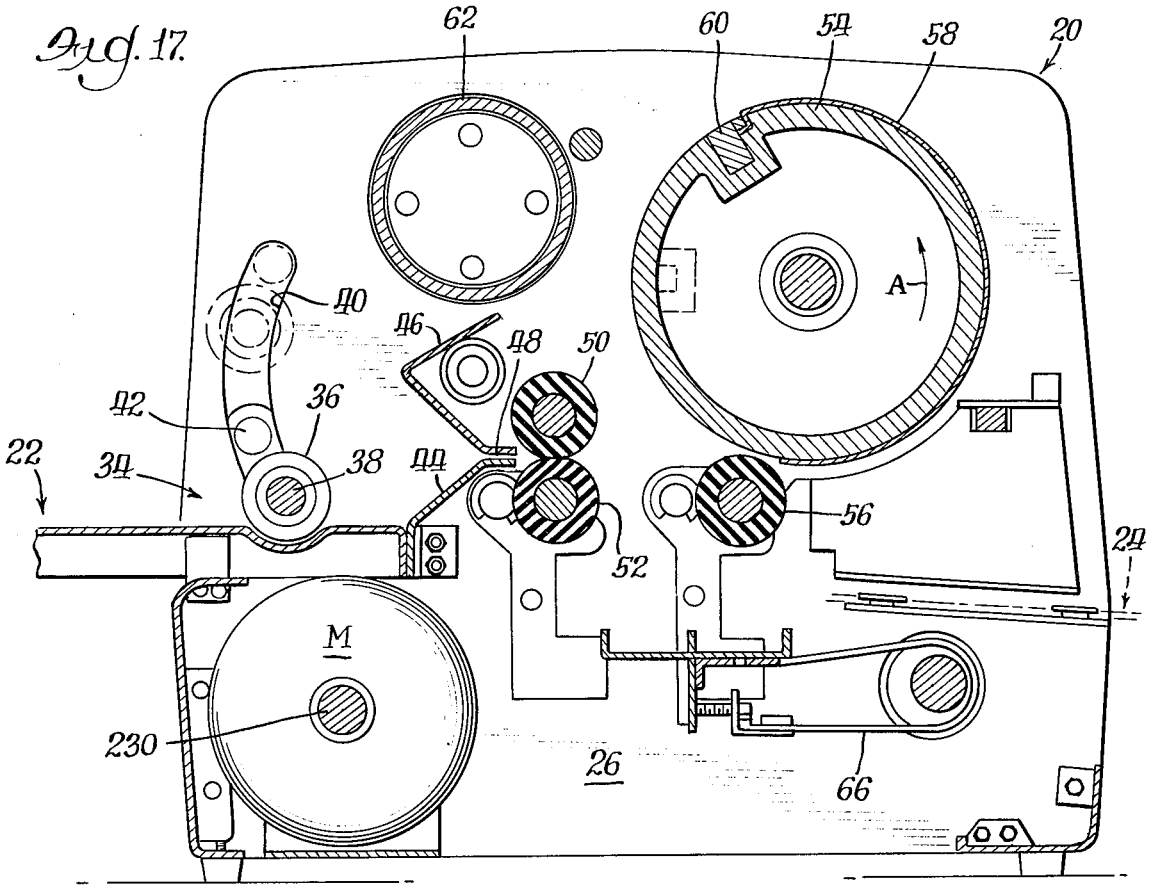
FIG. 17 is an upright longitudinal cross sectional view of the machine showing the position of the master sheet clamp for short paper when the machine is automatically stopped with the tail end of the master sheet clearing the impression roll.

Referring to FIGS. 1 and 17, the duplicating machine comprises a frame or housing generally designated 20. For the purpose of facilitating reference to the machine and its parts, the view of the FIGS. 1 and 17 may be considered as taken at an angle from the right, front, the machine having a feed table or tray 22 at the front, inlet end; a receiving tray 14 at the rear, outlet end; and left and right side walls 26 and 28 respectively.

The feed table 22 is shown and described in detail in Springer U.S. Pat. No. 3,417,988, issued Dec. 24, 1968 on "SHEET GUIDING MECHANISM". Briefly, it supports a stack 30 of copy sheets 32 at the input end in position to be advanced one at a time into the housing.

Feed means 34 comprises a pair of rubber-like feed wheels 36 mounted on a rotatable shaft 38 which extends through arcuate slots 40 in the side walls 26, 28 for up and down movement therein. Associated with the feed wheels 36 and shaft 38 is a bar 42 positioned above the shaft and secured in a rigid assembly therewith, serving as a means for grasping by the hand to lift the feed wheels. Upon rotation of the feed wheels counterclockwise as viewed in FIGS. 1 and 17, the top copy sheet 32 is frictionally gripped thereby and fed from the top of the stack into the machine and guided by deflectors 44 and 46 extending transversely across the machine and forming a concave receiving deflecting zone operative for guiding the leading edge of the copy sheet through the horizontal slit 48 into the nip between moistening roll 50 and presser roll 52 which, in turn, forward the copy sheet to the nip between the drum 54 and impression roll 56. A master sheet 58 is carried on the drum by means of a clamp 60 which grips the head or leading edge of the master sheet in a groove in the surface of the drum.

The moistening roll 50 is coated with a fluid from a tank 62 by a wick, valve, and trough arrangment not shown but illustrated and described in Springer et al U.S. Pat. No. 2,830,534, issued Apr. 15, 1958 on "DUPLICATING MACHINE". The fluid moistens the upper surface of a copy sheet just before it is pressed by the impression roll 56 against the master sheet on the drum, thereby activating the latter to transfer the printing copy or image to the copy sheet which is then discharged to the receiving tray 24.

An electrical motor M drives the drum 54 through a pulley, belt, and clutch arrangement supported in the housing adjacent the right hand side wall 28. This comprises an important part of the invention and will be described later, in detail.

Figures 6, 10:
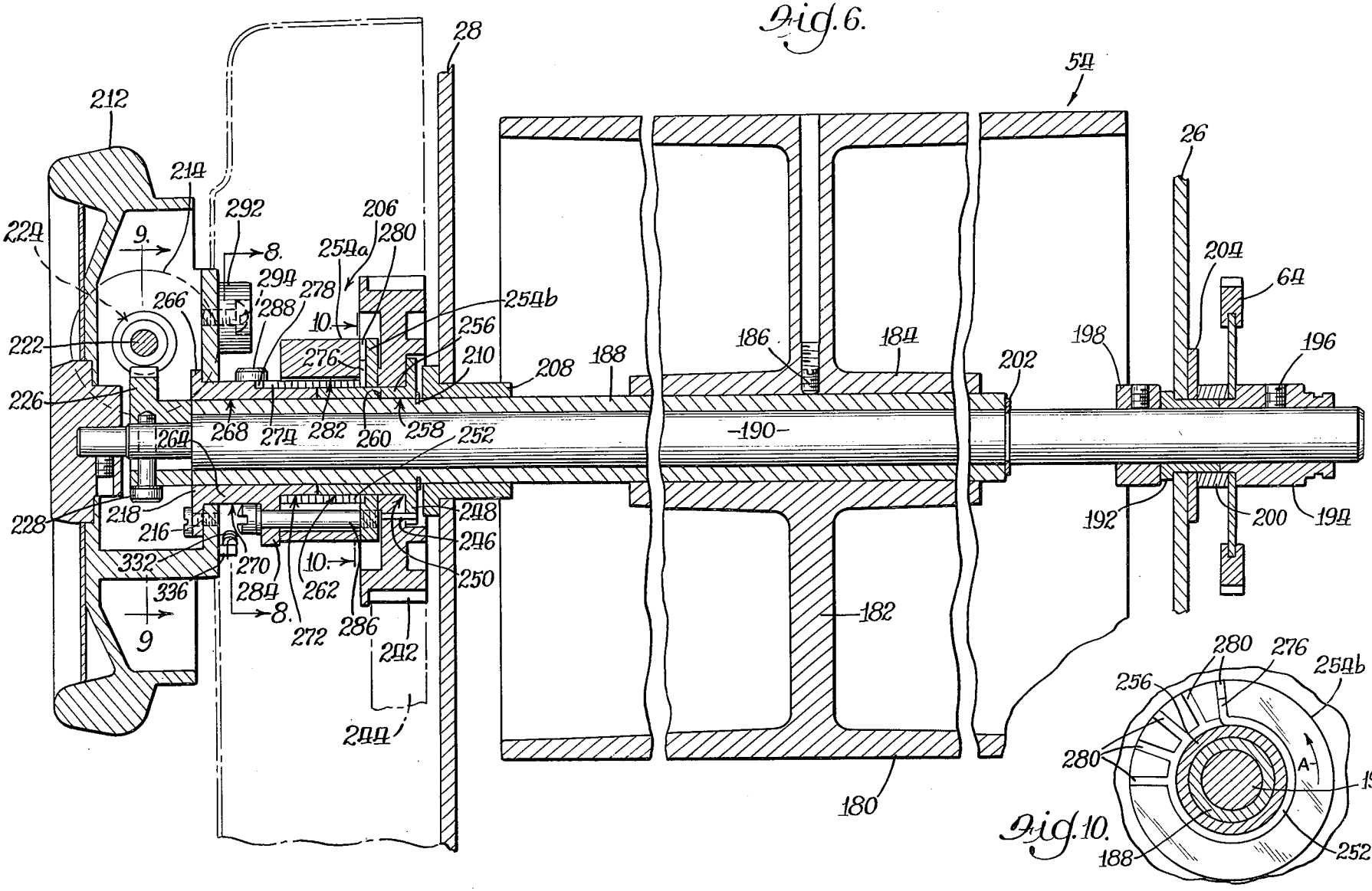

As shown in FIG. 6, the drum 54 has a gear 64 connected outside the left side wall 26. Gear 64 drives the feed wheels 36 and moistening roll 50, each in a counterclockwise direction (FIG. 17), and synchronizes their rotations with the drum by means not specifically shown because it forms no part of the present invention, but which may comprise a gear train and clutch arrangement similar to that shown and described in Springer U.S. Pat. No. 2,961,947 issued Nov. 29, 1960 on "DUPLICATING MACHINE".

A tensioning device 66 regulates the pressure exerted by rolls 52 and 56 on roll 50 and on drum 54 respectively. The mounting for these rolls and the tensioning device are fully described in the above-mentioned U.S. Pat. Nos. 2,830,534 and 2,961,947. The individual feed wheels 36 are shown and described in Springer U.S. Pat. No. 3,063,711 issued Nov. 13, 1962 on "PRESSURE CONTROL FOR SHEET FEED MEANS IN DUPLICATING MACHINE".

Figure 2:
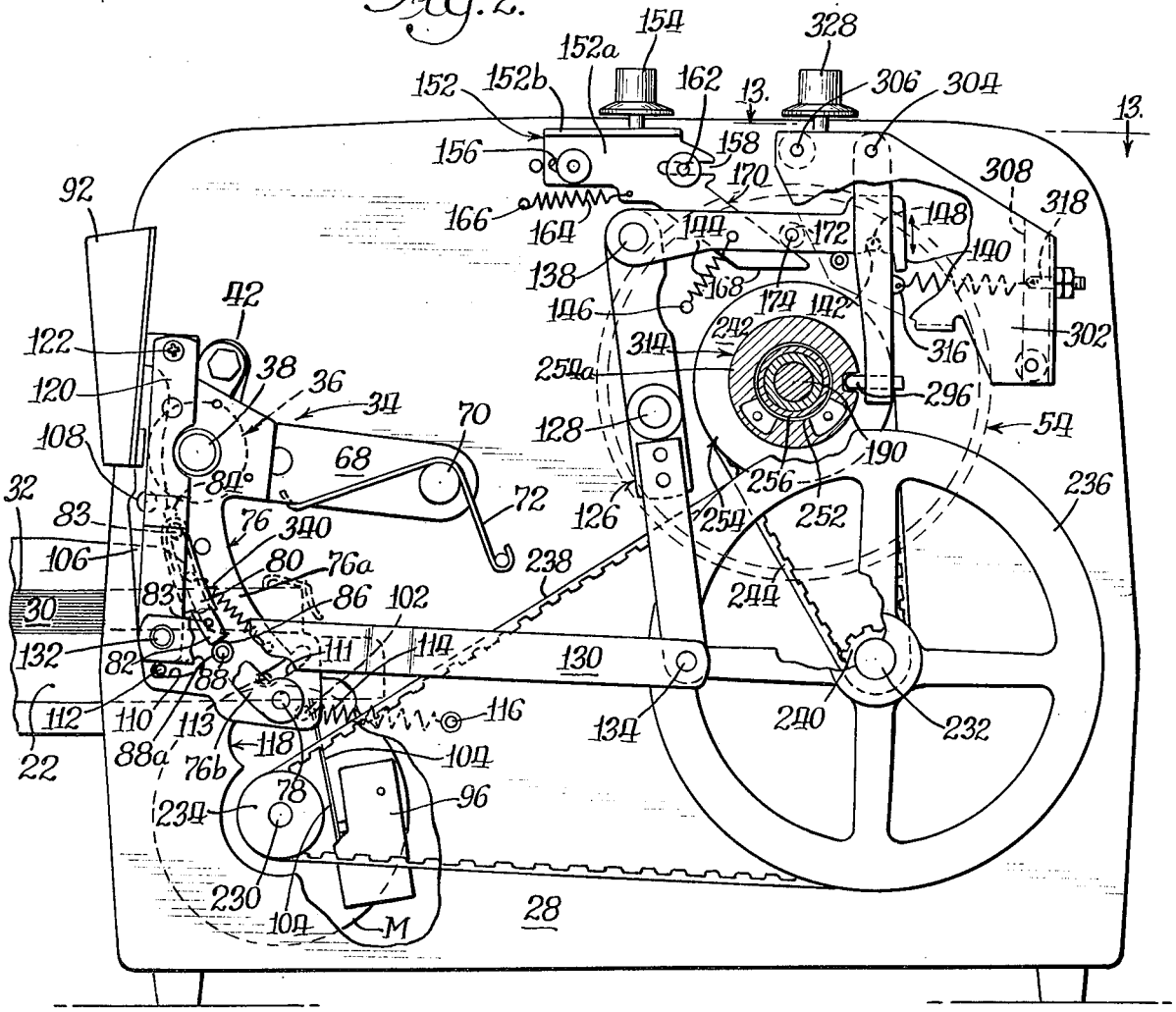
FIG. 2 is a partly cross sectioned side view of the machine with the right hand cover plate removed, in stopped condition, with the feed wheel assembly elevated to illustrate readiness to begin a printing operation.
Figure 4:
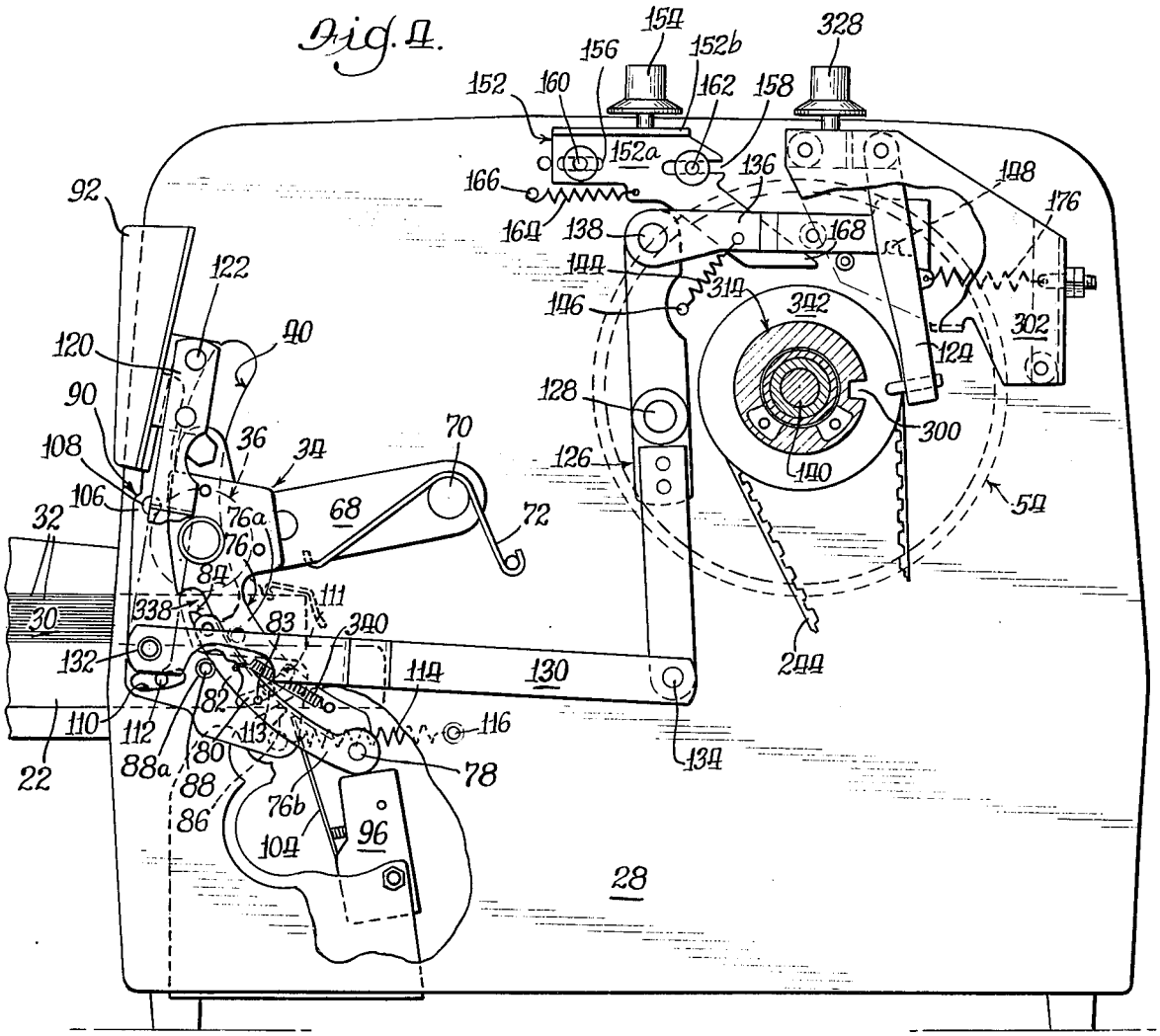
FIGS. 4 and 5 are views generally similar to FIG. 2 showing the machine in running and automatically stopped conditions respectively.
Figure 5:
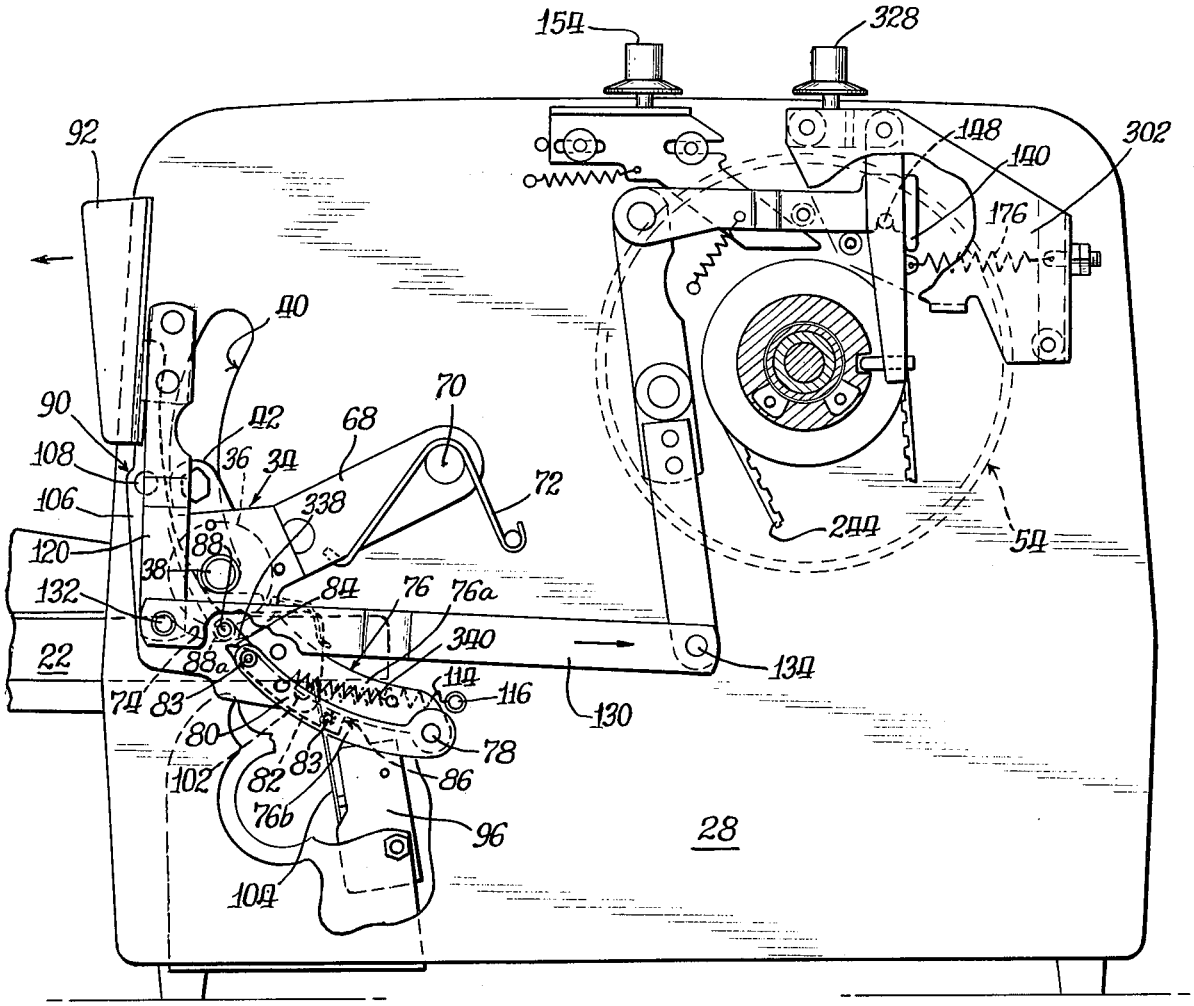

Refer now to FIGS. 2, 4 and 5, for additional details of the feed means 34 not shown in the small scale FIGS. 1 and 17. The shaft 38 and bar 42 are mounted for vertical tilting movement between side arms 68 swingable up and down about the axis of a pair of aligned studs 70 on which the arms are pivoted at opposite sides of the machine. Gravity urges the assembly downward to enable the feed wheels 36 to follow the stack of copy sheets 32, thereby forming a sensing device for controlling means to automatically shut off the machine when the last copy sheet has passed through the machine. Preferably a spring such as a hair pin spring 72 is arranged for biasing upwardly on one of the arms 68, and thus on the shaft 38 carrying the feed wheels, to control the pressure of the latter on the stack. As described above, each of the side walls 26 and 28 is provided with an arcuate slot 40 for receiving the feed wheel shaft 38 and bar 42. The bottom ends of these arcuate slots define the lower limit to which the assembly may drop after the last copy sheet is fed into the machine, this condition being shown in FIG. 5 where the feed wheels 36 are dropped into depressions 74 in the bottom of the feed table 22.

At the right side of the machine, namely, the side that is visible in FIGS. 2, 4 and 5, the arm 68 has a lower extension generally designated 76. This extension includes a main portion 76*a* extending downwardly and arcuately about the axis of studs 70 on which the arm 68 is pivoted. Mounted on the lower end of that portion 76*a* is a supplemental portion consisting of an arm 76*b* arranged for swinging movement on a pivot pin 78 fixed on the lower end of the main portion 76*a*. This supplemental arm 78*b*, as shown in FIGS. 2, 4 and 5, is arcuate, following the curvature of the main portion 76*a* itself, and is itself made up of an outer element 80 and an inner element 82 which are fastened together as by rivets 83. The inner element 82 is shorter than the outer element and has an upper, pointed camming surface 84, and a downwardly facing, flat end surface 86 disposed for engaging a pin 88 on a starter arm assembly next to be described.

Figure 19:
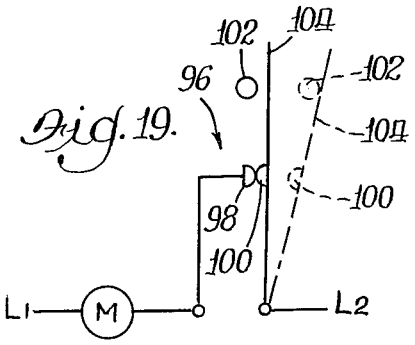
FIG. 19 is a schematic electric circuit for the drive motor.

The starter arm assembly generally designated 90 is disposed at the right side of the machine adjacent the front. It includes a pushbutton 92 extending through the front edge of the right hand casing cover 94 for easy access to the operator. This starter arm assembly performs a certain operating function in connection with the feed wheel assembly 34 and control switch 96 for the motor M. As shown in FIG. 19, switch 96 is of the normally closed type, actuating the motor M by connecting it through contacts 98/100 to electrical power leads $L_1$ and $L_2$ when a switch control arm stud 102 (to be described) is moved to the left, to the solid line position shown in FIG. 19, clear of the switch actuator arm 104. When the control arm stud 102 is moved to the right as shown in broken lines in FIG. 19, it opens the switch and deactuates the motor.

Referring to FIG. 2, the starter arm assembly 90 includes a first lever 106 which may be generally in the form of a flat plate and is pivoted intermediate its ends on a pin or stud 108 fixed on the right hand side wall 28. Adjacent the lower end of the lever 106 are two arcuate slots 110 and 111. These are guidingly engaged with pins 112, 113 respectively, which are fixed on the side wall 28. The starter arm assembly 90 is biased in a counterclockwise direction about the stud 108, to the outer position shown in FIGS. 2 and 5, by suitable means such as a coil spring 114 connected between the switch control arm stud 102 on the left (inside) of lever 106 and an anchor pin 116 fixed on the inside of side wall 28.

Also, adjacent that lower end of lever 106 is external pin 88, mentioned above. This will preferably have an antifriction roller 88*a* on it. This is engageable with the lower extension 76 of the feed wheel assembly 34, the details of which will be described immediately below. It will be understood that the switch control arm stud 102 extends through an opening 118 in the side wall 28, inasmuch as the first lever 106 on which the stud 102 is mounted is outside that side wall, and the switch 96 is inside it.

The starter arm assembly 90 includes a second lever 120 overlying the first lever 106, and fastened to the pushbutton 92 by one or more screws 122. Lever 120 provides a connection to the stop arm 124. This will now be described.

Figure 16:
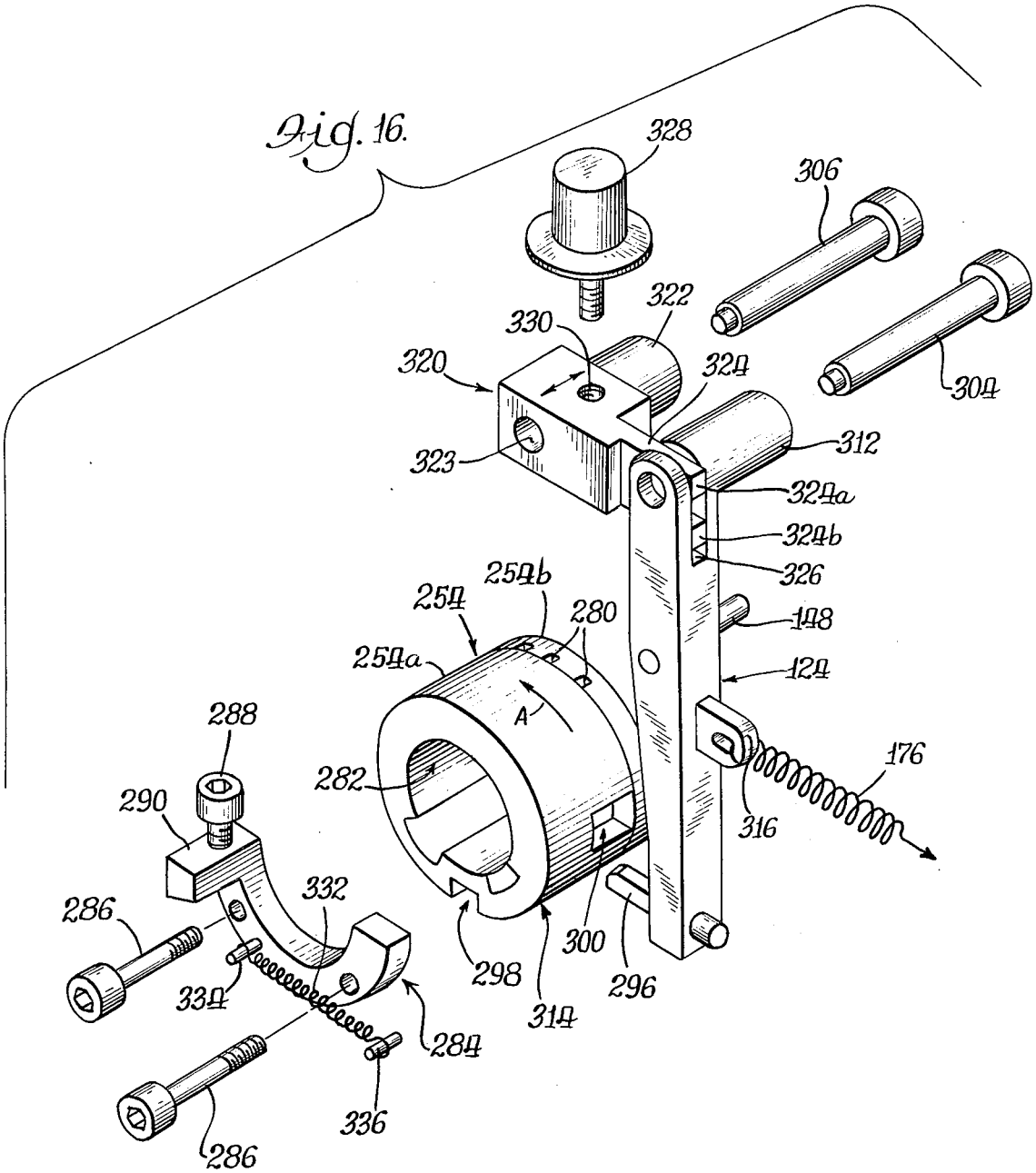
FIG. 16 is an exploded perspective view of the stop arm and some associated components.

As shown in FIGS. 2, 4 and 5, a trip arm lever 126 is pivoted intermediate its ends on a stud 128 fastened to the side wall 28. The lower ends of 120 and 126 are respectively pivotally interconnected to the ends of a horizontal link 130. These interconnections include pivot pins 132 and 134. Another horizontal link, a stop release latch 136, is pivotally connected at its front end to the top of trip arm lever 126, by a pivot pin 138. At its rear end (to the right in FIGS. 2, 4 and 5) the latch 136 has, at its vertically swinging end, a downward, hook-like extension 140, and a downwardly facing notch 142 a short distance forwardly from the end. A coil spring 144 is connected between the latch 136 and an anchor stud 146 on side wall 28 to bias the latch in a clockwise direction about its pivotal connection 138. As best shown in FIG. 16, a stop sleeve pin 148 extends inwardly from the side of the stop arm 124 intermediate its ends. This pin is alternately seated in the notch 142 as shown in FIGS. 2, 4 and 5, and in the lower, rear bottom corner 150 of the latch 136 just inside the extension 140, as shown in FIG. 3.

Figure 3:
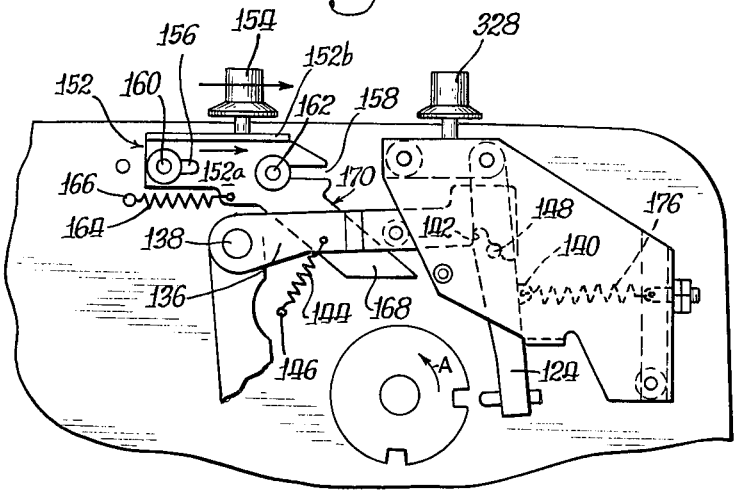
FIG. 3 is a fragmentary view similar to FIG. 2 showing the stop release button actuated preliminarily to adjusting from use with one master sheet length to another.

As shown for example in FIGS. 2, 3, 4 and 5, there is a stop release bracket 152 consisting essentially of a flat vertical plate portion 152*a* and a top horizontal flange portion 152*b* having a stop release button 154 fixed to it. The bracket 152 has a pair of aligned slots 156 and 158 embracing a pair of studs 160 and 162 on side wall 28. This slot and stud connection guides the stop release bracket for forward and backward movement. A spring 164 is connected between the bracket and an anchor stud 166, biasing the bracket in a forward direction, that is, to the left in FIGS. 2, 3, 4 and 5. The bracket has a depending, lifting blade portion 168 with an upper, diagonal camming edge 170 engageable with a roller 172 carried on a pin 174 at the back side of latch 136. Rearward movement (that is, to the right as shown in FIG. 3) of the stop release button 154 causes the camming surface 170 to engage the roller 172 and lift the latch 136 to disengage the notch 142 from the stop sleeve pin 148. This enables spring 176 to pull the stop arm 124 rearwardly and seat the stop sleeve pin 148 in the corner 150, to adjust the mechanism for a different length master sheet as will be explained. The position in which the pin 148 is seated in the corner 150 is illustrated in FIG. 3. Note that, as shown in FIGS. 2, 4 and 5, the latch 136 is guided for back and forth movement on a roller 178 fastened to the side wall 28; but in FIG. 3, engagement of the pin 148 in corner 150 holds the latch up, out of engagement with the guide roller 178.

Referring to FIG. 6, the drum 54 is a cylinder 180, open at opposite ends, connected by a central web 182 to a coaxial inner sleeve 184 fastened by set screw means 186 to a drum mounting sleeve 188. The latter, in turn, is mounted for rotatable adjustment relative to the drum shaft 190. At the left side of the machine (to the right in FIG. 6) the drum shaft 190 is rotatably journaled in a flanged sleeve bearing 192 mounted on the left side wall 26. As described, gear 64 may be meshed with gear and clutch means (not shown) which drives the feed wheels 36 and rolls 50 and 52 and synchronizes them with rotation of the drum. The gear 64 is mounted on hub 194 fast to the end of shaft 190 by a set screw 196. A collar 198, spacer 200 and spring retaining ring 202 engaging the end of sleeve 188 limit endwise play of the drum. A pressure arm 204 pivotable about shaft 190, enables the operator to adjust the tensioning device 66 described in connection with FIG.

17 and thereby adjust the pressure applied by rolls 52 and 56 against copy sheets passing through the machine. Details of the pressure arm 204 and associated parts are not shown because they form no part of the present invention but they are described in the above-mentioned Springer et al U.S. Pat. No. 2,830,534.

Refer to the left side of FIG. 6. Acutally, as described, this is the right side of the machine. This shows the improved clutch mechanism generally designated 206, and associated components, which comprise an important part of the present invention. The sleeve 188 is rotatably journaled in a flanged sleeve bearing 208 mounted on side wall 28. A spring retaining ring 210 outside the bearing 208 controls endwise movement of the sleeve. Mounted at the outer end of the drum sleeve 188 and drum shaft 190 is a hand wheel 212. The drum is mounted for adjustment angularly with respect to the shaft 190, this being done by means of thumb wheels 214 in the manner described in the above-mentioned Springer et al U.S. Pat. No. 2,830,534. Briefly, the hand wheel 212 is mounted by screws 216 to a flanged sleeve 218 which, as will be described, is the driven member of the clutch means forming part of the present invention. That sleeve-shaped, driven member 218 is, in turn, connected to the drum sleeve 188 by a pair of cap screws 220 as shown in FIG. 8. The thumb wheels are mounted on transverse shaft 222 (FIGS. 6 and 9) which is journaled on the hand wheel. The shaft 222 has a worm 224 engaging a worm gear 226 fastened by bolt 228 to the end reduced diameter end of drum shaft 190. Thus, the drum shaft 190 and drum sleeve 188 are locked for rotation as a unit by the worm and worm wheel arrangement described, enabling the drum to be turned manually by the hand wheel, or by power means through the improved clutch to be described.

The electric motor M drives the drum 54 through a two-stage reduction. Motor drive shaft 230 drives a countershaft 232 through pulleys 234 and 236 and a primary belt 238. The countershaft 232 has a second, smaller pulley 240 which drives the drum driving pulley 242 through a secondary belt 244. As shown in FIG. 6, the driving pulley 242 is connected by pins or rivets 246 to the flange portion 248 of a driving clutch member 250 which is rotatably journaled on the drum sleeve 188.

Refer to FIGS. 6 and 7. An important part of the present invention is the coil spring type clutch mechanism generally designated 206 acting between motor M and drum 54. This clutch means includes the driving member 250, the driven member 218, coil spring clutch member 252, release collar 254, and the stop arm 124. These individual parts, and their copperation, will now be described.

The driving member 250 has a sleeve portion 256 extending outwardly from the flange portion 248. The sleeve portion has an inner cylindrical bore 258 rotatably journaled on the outer cylindrical surface 260 of sleeve 188; and an outer cylindrical friction surface 262.

The driven clutch member 218 has a sleeve portion 264 and a flange portion 266. The sleeve portion has an inner cylindrical bore 268 fitted onto the outer cylindrical surface 260 of the sleeve 188 and is mounted for rotation therewith by means of the cap screws 220 above described. As described, the flange portion 266 is connected to the hand wheel by the screws 216; or rivets or pins may be employed. The outer surface includes a first cylindrical surface 270 and a second, smaller-diameter, cylindrical friction surface 272 equal in diameter to that of cylindrical friction surface 262 on the driving member.

Figure 12:
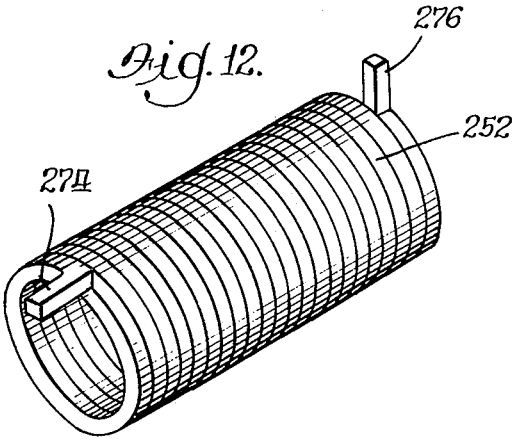
FIG. 12 is a perspective view of the coil spring clutch component.

Referring to FIGS. 10 and 12, the coil spring clutch member 252 is a closely wound coil spring of square or rectangular wire cross section having axially- and radially-extending tangs 274 and 276 respectively at opposite ends. Referring to FIG. 6, the coil spring clutch member 252 is assembled with its inside diameter in interference fit with the outer cylindrical surfaces 262 and 272 of the driving and driven members. The axial tang 274 is retained in an axial slot 278 in the driven member. The radial tang 276 is retained in one of a series of optionally usable, circumferentially spaced, radial slots 280 in the release collar not to be described.

Figure 15:
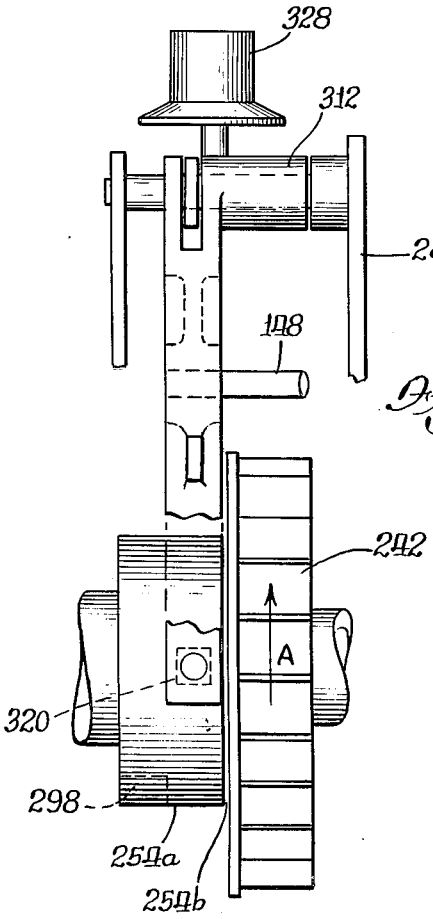
FIG. 15 is a vertical view of FIG. 13 taken along line 15—15.

As shown in FIGS. 6 and 16, the release collar 254 is generally annular in cross section and comprises two parts **254*a* and 254*b*. Part 254*a* encircles the cylindrical surfaces 262 and 272 of the driving and driven clutch members. The bore 282 in the release collar is sufficiently larger in diameter than the cylindrical friction surfaces 262, 272, to define an annular cross section space for the coil spring clutch member 252. Part 254*b* is positioned at the end of part 254*a*, as shown in FIGS. 6, 15 and 16. A view of part 254*b* showing the plurality of radial slits 280 is shown in FIG. 10. As described above, the radial tang 276 is positioned in one of these slots. Thus, by having a plurality of the slots 280 (or alternatively a plurality of the axial slots 278), twist variations in the coil spring clutch member 252 during manufacture can be compensated for, and the rotational position of the drum 54 relative to the release collar 254 can be adjusted where desired. At the outer end of the release collar, as shown in FIGS. 6, 8, 11, 15 and 16, the release collar has an arcuate stop bracket 284 mounted thereon by a pair of cap screws 286 which extend all the way through into part 254*b* into which they are screwed to hold the three components 254*a*, 254*b* and 284 together. The bracket 284 has an adjustable stop screw 288 threadedly engaged in a boss 290. As will be explained, the screw 288 is one of two shock absorber or bumper elements, the other being a rubberlike or plastic bumper disc 292 fastened to the inside of the hand wheel by a screw 294.**

When the motor M is actuated through normally closed contacts 98/100 of switch 96, it rotates the driving pulley 242 counterclockwise as seen in FIGS. 2, 4 and 5. When this occurs while the clutch mechanism 206 is engaged, this drives the drum 54, hand wheel 212, and all associated parts counterclockwise, in the direction of the arrow A on several of the figures.

The principles of construction and operation of the clutch mechanism 206 are best shown in FIG. 7. For these purposes, some of the components are deliberately shown out of scale, and the coil spring clutch member 252 is in open form to show the driving and driven members inside it and to emphasize the direction of helical wrap of the coil spring clutch member.

As shown, the coil spring clutch member is helically wound in the direction to contract it and thereby tighten the interference fit between it and each of the cylindrical friction surfaces 262 and 272 of the driving and driven clutch members 250 and 218 respectively. Thus, if the release collar 254 is free to rotate when the drum driving pulley 242 is driven in direction A, the coil spring clutch member contracts, tightens the interference fit on both friction surfaces 262 and 272, and drives the drum at the same speed as the driving pulley itself. By contrast, if the release collar 54 is suddenly stopped (as by stop arm pin 296 dropping into one or the other of stop recesses 298 or 300, to be described), the radial tang 276 at the driving end of the clutch spring, which is connected to the release collar, will be stopped, causing the spring to expand and disengage the clutch by releasing the interference fit with surface 262. The driving pulley 242 and driving clutch member 250 can then continue rotating while the release collar 254, clutch spring 252, hand wheel 212, drum 54, and associated parts are all stopped.

One important feature of the invention which is clearly illustrated in FIG. 7 is that the release collar 254 is connected to the drum (through driven clutch member 218) by means of a spring, here illustrated as the coil spring clutch member 252. Thus, by stopping the release collar at a position determined by one or the other of the stop recesses 298 and 300, the stopped position of the drum, and therefore the position of the tail or trailing end of the master sheet 58 relative to the impression roll 56, can be predetermined by the locations of these stop recesses. Further, while stopping of the release collar will be instantaneous when the stop arm pin engages the recess, the drum will overrun slightly in a definite amount as permitted by the torsional elasticity of the spring. To prevent excessive unwinding of the spring due to the rotational momentum of the drum and hand wheel assembly at the instant of stopping the release collar, the bumper 292 can be made to engage the adjustable stop screw 288 after any predetermined rotational overrun of the drum. FIG. 8 shows the bumper 292, in broken lines, at the instant that this rotational overrun is completed by the bumper engaging the screw 288.

The present invention provides means to automatically release the clutch 206, and thereby stop the drum 54 at a predetermined rotating position just after the end of the master sheet 58 has passed beyohnd the nip between the drum and impression roll 56. This means is manually adjustable to stop the drum at different rotated positions, for different length master sheets, as shown in FIGS. 13 through 18. An important part of this means is the stop arm 124 and its cooperation with the release collar 254 which will now be described.

Referring first to FIGS. 13 through 16, a vertical brace plate 302 is supported in spaced parallel relation to the right hand side wall 28 by a pair or parallel, upper guide pins 304, 306 and a bracket 308. Pins 304 and 306 are riveted to the side wall and brace plate, and the bracket 308 is fastened in any suitable manner by rivets or screws 310.

Stop arm 124 (see also FIG. 16) has a hub 312 with a bore pivotally and slidably engaging pin 304. At its lower, free end, the stop pin 296 extends toward the release collar 254. The stop pin is adapted to engage the outer, cylindrical guide surface 314 on the release collar, before dropping into one or the other of the detent recesses 298 and 300 with which it is aligned. As described, the stop sleeve pin 148 is engageable with the stop release latch, either in the notch 142 or the corner 150. Spring 176 is connected between a stop arm ear 316 and a bolt 318 through the bracket 308 to bias the stop arm in a rearward direction tending to disengage the stop arm pin from the release collar. Thus, when the stop release latch 136 is released by button 154 as described in connection with FIG. 3, spring 176 automatically disengages the stop arm pin 296 from either of the detent recesses 298 and 300 in the release collar. However, when the stop sleeve pin 148 is retained in notch 142 of the stop release latch, as shown in FIG. 2, the start arm spring 114, being stronger, will overcome the stop arm spring 176 and hold the stop arm pin engaged within one or the other of the release collar detent recesses.

Referring further to the selector mechanism shown in FIGS. 13–16, a stop arm guide 320 has a hub 322 with a bore 323 engaging pin 306 and mounting it for slidable movement back and forth with the stop arm. A bifurcated blade-like extension 324 has upper and lower furcations engaging the top and bottom of pin 304 within a vertical slot 326 in the stop arm 124. A copy selector button 328 is threadedly engaged with an upper tapped hole 330 in the stop arm guide 320.

Figure 18:
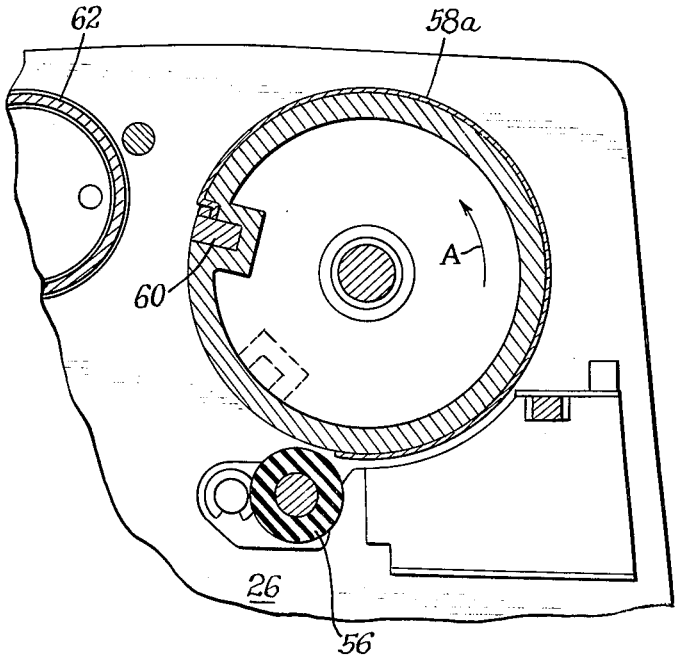
FIG. 18 is a fragmentary view similar to FIG. 17 showing the position of the master sheet clamp when the machine is automatically stopped with the tail end of a master sheet for long paper clearing the impression roll.

The outer cylindrical guide surface 314 of the release collar part **254*a* has the two circumferentilly and axially spaced detent recesses 298 and 300 previously described, for stopping the drum selectively in one or the other of the positions shown in FIGS. 17 and 18, for short master sheets, and long master sheets, respectively. It will be apparent that if desired only a single detent recess, either 298 or 300**, may be employed in practicing the invention. Alternatively, more than two may be employed if the machine is to be readily selectible for more than two lengths of master sheets.

Refer now to FIGS. 6, 8 and 16. A stop arm spring 332 has one end connected to a pin 334 on the stop bracket 284 fastened to the release collar; and has its other end connected to a pin 336 fastened to the inside of the hand wheel 212. The purpose of this spring 332 is to prevent partial, inadvertent, or premature release of the interference fit between the spring clutch member 252 and the cylindrical friction surface 262 on the driving clutch member 250 when the stop arm pin 296 engages the cylindrical guide surface 314 on the release collar. By exerting a slight counterclockwise torque on the release collar with respect to the hand wheel, this counteracts any possible loosening effect caused by frictional drag between the stop arm pin 296 and the rotating surface 314.

Use and Operation

The manner of operation of the machine in normal use will now be described. For this purpose, assume the position of rest which is normal for the machine between periods of operation. This is shown in FIG. 2 where the pushbutton 92 is biased outwardly (to the left) by start arm spring 114. The normally open switch 96 is held in its "Off" condition by stud 102 holdng the switch actuator in the broken line position shown in FIG. 19. The feed wheel assembly 34 is held in its raised position by the lower end surface 86 resting on pin 88.

With the machine set according to the foregoing, the operator places a stack of copy sheets 32 on the feed table 22 and aligns them in proper position. Assume that the copy sheets so placed in the machine are 11'' long. Assume further that the master sheet 58 on the drum is for 11'' copy sheets. If the stop arm 124 is not already aligned with detent recess 300, which in the present embodiment is for 11'' paper, he will press the stop release button 154 backward (to the right in FIG. 3) to lift stop release latch 136 and disengage it from the stop sleeve pin 148. This enables spring 176 to pull the stop arm 124 rearwardly (to the right in FIG. 3) and disengage it from the release collar as shown in FIG. 3.

Figure 14:
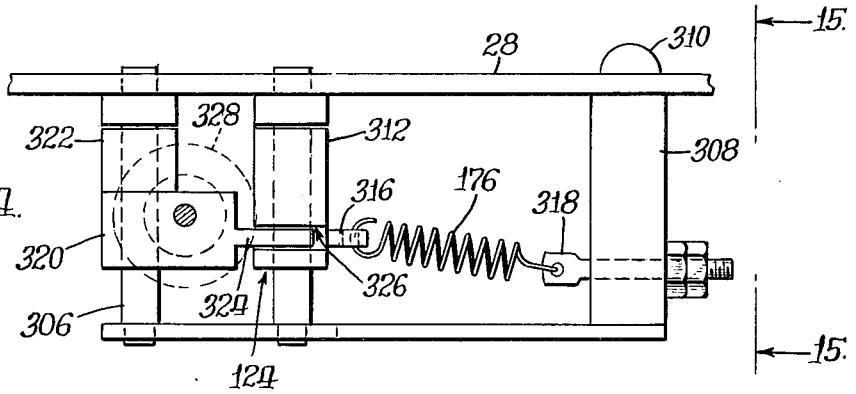

With the stop arm so released, the operator moves the copy selector button 328 to the left, to the position shown in FIG. 14. This aligns the stop arm 124 with stop recess 300 as shown in FIG. 15.

The operator then depresses the pushbutton 92. This rocks the starter arm assembly 90 in a clockwise position from the position shown in FIG. 2 to the "run" position shown in FIG. 4. This performs several functions, as follows: The stop arm 124 is moved rearwardly by the latch 136 to release the stop arm pin 296 from the detent recess 300. Just as the stop arm pin 296 clears that recess, the switch control arm stud 102 has moved forwardly sufficiently to close switch contact 98/100, and the motor M starts. Pin 88 on the starter arm is moved forwardly from beneath the end surface 86 and no longer supports the feed wheel assembly in lifted position. This allows the feed wheel assembly to drop with the feed wheels 36 engaging the top copy sheet in the stack.

The feed arm assembly functions as a copy sheet sensing means because the farther down it drops, the fewer copy sheets remaining in the stack, until finally the last copy sheet is fed into the machine and the feed wheels drop into the depressions 74 as shown in FIG. 5. This is the bottom stop position in which the feed wheel assembly 34 senses the last copy sheet being fed into the machine by dropping down to a level where the opening 338 (FIGS. 4 and 5) above the supplemental arm portion **76*b* of the lower extension 76 drops to a position level with the pin 88 on the starter arm assembly. The start arm spring 114 then rotates the starter arm assembly counterclockwise, and the starter arm pin 88 is drawn into the opening 338 as the pushbutton 90 moves outward. This moves the latch 136 forward sufficiently to cause stop arm pin 296 to engage the cylindrical guide surface 314 on the outside of the release collar 254. As the release collar continues to rotate, it will reach a point where the stop arm pin 296 registers with the 11" paper detent recess 300 and drops into it. As this happens, the latch 136 will correspondingly move forward under the urgence of start arm spring 114. This will be accompanied by additional forward movement of the switch control arm stud 102 against the switch actuator arm 104 sufficient to open the switch contacts 98/100** and deactuate the motor.

At this instant, the release collar 254 has been stopped by the stop arm pin 296 thereby expanding the coil spring clutch member sufficiently to release the interference fit with the friction surface 262 and allow the driving member 250 and now-deactuated motor to coast to a stop; and the driven member 218 and drum 54 to which it is attached are at the same instant overrunning, with the bumper 292 approaching the stop screw 288. When the bumper strikes the stop screw, the drum will stop. If it rebounds, even slightly, this will be a controlled kind of rebound occurring to the same degree each time, so that whether there is rebound or not, the drum stops at the same rotated position each time. By properly locating the position of the stop recess 300 in the release collar, the master sheet 58 for 11" copy paper will just clear its trailing end beyond the impression roll as shown in FIG. 17. Note that in this position, the clamp 60 for the head end of the master sheet is conveniently accessible at the top of the machine.

Figure 13:
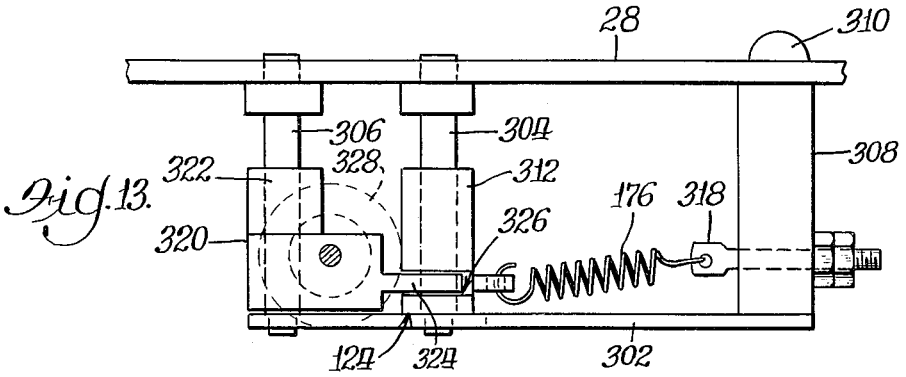
FIGS. 13 and 14 are fragmentary horizontal sectional views taken along line 13—13 of FIG. 2, showing alternate adjustments for different length master sheets.

For longer copy sheets, say 14", a longer master sheet **58*a* (FIG. 18) will be used. By sequentially operating the stop release button 154 and copy selector button 328, the stop arm can be shifted toward the right, aligned with the detent recess 298, as shown in FIG. 13. Operation of the machine will be precisely as described above for the shorter paper except that when the last copy sheet is fed into the machine, it automatically stops the drum with the longer sheet clearing the impression roll as illustrated in FIG. 18.**

To reset the machine to the FIG. 2 position, from the FIG. 5 position, it is necessary only to grasp the bar 42 and lift it to its upper limit. As the feed wheel assembly 34 moves upward, the upper pointed camming surface 84 will first engage the pin 88. As the assembly is lifted, the supplemental arm portion **76*b* will pivot outwardly about its pin 78 until the lower end surface 86 rises above it, at which time the spring 340 which is connected between the arms 76*a* and 76*b* will pull the supplemental arm 76b rearwardly (to the right in FIG. 2) where the top stop, ready condition of FIG. 2** will be reestablished.

While one form in which the present invention may be embodied has been shown and described, it will be understood that various modifications will be made within the spirit and scope of the invention which should be limited only by the appended claims.

The embodiments of the invention in which an exclusive property or privilege is claimed are defined as follows:

1. In a duplicating machine having a frame, a rotatable printing drum with means for supporting a master sheet thereon, an impression roll positioned to press copy sheets against the master sheet on the drum, a support for a stack of copy sheets adjacent an inlet end of said housing, feeding means for advancing copy sheets successively from the stack into the housing between the drum and impression roll for printing from the master sheet onto the copy sheet, drive means for rotating the drum, means for automatically stopping the drum with the end of the master sheet at a predetermined position beyond the impression roll comprising in combination:

clutch means including driving and driven clutch members connected respectively to said drive means and to said drum, means for engaging said clutch members to enable said drive means to rotate said drum, a release collar connected to said driven member for rotation therewith and being rotatable with both said clutch members when so engaged, and means to disengage said clutch members and enable said drum to stop at a position corresponding to the stopped position of the release collar in response to stopping the rotation of said release collar;

stop means for said release collar including detent means on said release collar and a stop arm which is movable to and from a stop position engaging said detent means to thereby stop said release collar;

a manually movable starter arm movable to and from a start position;

means including a mechanical connection between said starter arm and said stop arm being responsive to manual movement of said starter arm to its said stop position to move said stop arm away from its said stop position and to simultaneously actuate said drive means to rotate said drum through said clutch means;

means including copy sheet sensing means having a follower sensitive to said stack of copy sheets to maintain said starter arm in its said start position while a copy sheet in said stack remains on said support; and said means including said copy sheet sensing means being further responsive to the last copy sheet leaving the support to automatically move said stop arm into engagement with said detent means to stop said release collar and to disengage said clutch members while simultaneously deactuating said drive means to stop said drum at a predetermined position corresponding to the stopped position of said release collar.

2. In a duplicating machine, the combination of claim 1 in which said release collar is connected to said driven member for rotation therewith by spring means enabling limited rotational overrun of said driven member and drum relative to said release collar when the latter is stopped.

3. In a duplicating machine, the combination of claim 2 in which there are circumferentially spaced bumper elements on said release collar and driven member respectively, said elements being engageable to limit said rotational overrun of said driven member and drum to an extent within the elasticity of said spring means.

4. In a duplicating machine, the combination of claim 3 in which the circumferential spacing of said bumper elements is adjustable to vary the extent of said rotational overrun of said driven member and drum.

5. In a duplicating machine, the combination of claim 1 in which said detent means includes a plurality of detents circumferentially spaced about the axis of said release collar, and selector means is provided for selectively engaging said stop arm with said detents to stop said driven member and drum at different rotated positions for different length master sheets.

6. In a duplicating machine, the combination of claim 5 in which said detents are axially spaced along the axis of said release collar, and said selector means includes means for relatively moving said stop arm and release collar parallel to the axis of said release collar to align said stop arm with a selected one of said detents.

7. In a duplicating machine, the combination of claim 6 in which said release collar has a cylindrical guide surface, and said detents are recesses in said cylindrical guide surface within which said stop arm is selectively engageable, and said means including said copy sheet sensing means being responsive to the last copy sheet leaving said support to automatically move said stop arm against said cylindrical guide surface and then into a selected recess to stop said recess collar, and means responsive to moving said stop arm into said recess to deactivate said driving means and stop said driving clutch member.

8. In a duplicating machine, the combination of claim 7 including spring means biasing said stop arm away from said stop position;

said mechanical connection between said starter arm and said stop arm including a normally closed latch connection; and manually movable stop release means for opening said latch connection to enable said spring biasing means to disengage said stop arm from one of said recesses and enable it to be moved by said selector means into alignment with another said recesses.

9. In a duplicating machine, the combination of claim 7 including first spring biasing means urging said stop arm away from said stop position;

said mechanical connection between said starter arm and said stop arm comprising lever and link means;

said lever and link means including a pivotal latch having a releasable notch and pin connection with said stop arm;

second spring biasing means urging said latch in a direction to maintain said notch and pin connection; and manually movable stop release means for moving said latch against the bias of said second spring means to release said connection enabling said first spring biasing means to move said stop arm away from said stop position, free of said release collar, and further enabling said stop arm while so freed to be moved parallel to the axis of said release collar from one of said recesses to another.

10. In a duplicating machine, the combination of claim 1 in which said clutch means includes cylindrical friction surfaces on said driving and driven clutch members, a coil spring clutch member with opposite driving and driven end portions having interference fits with said cylindrical friction surfaces on said driving and driven clutch members respectively and being helically wound in a direction to tighten said interference fits in response to rotatably driving said driving clutch member in one direction, and to loosen said interference fits in response to rotational overrun of said driven clutch member in said one direction, and to loosen said interference fits and enable said driving clutch member to rotate freely in said one direction while rotation of said release collar is stopped.

11. In a duplicating machine, the combination of claim 10 in which the ends of said coil spring clutch member are positively connected to said driven clutch member and said release collar respectively, to synchronize the rotated position of said driven clutch member and drum with that of said release collar within limits determined by the torsional elasticity of said spring clutch member.

12. In a duplicating machine, the combination of claim 10 in which said release collar has a cylindrical guide surface in the plane of said detent means;

said stop arm is slidably supported on said guide surface while said release collar is rotating to thereby guide said stop arm into engagement with said detent means; and spring biasing means acting between said release collar and driven clutch member urging said release collar in a direction to tighten the wrap of said coil spring clutch member on the cylindrical surfaces of said clutch members and thereby counteract the loosening effect of frictional drag between said stop arm and cylindrical guide surface.

13. In a duplicating machine, the combination of claim 10 in which said coil spring clutch member has interconnections at its ends with said release collar and said driven clutch member, respectively, thereby enabling said driven clutch member and drum to rotatably overrun relative to said release collar when the latter is stopped, within limits determined by the elasticity of said spring clutch member; and circumferentially spaced, mutually engageable, bumper means respectively carried by said driven clutch member and said release collar to limit rotatable overrun of said driven clutch member and drum relative to said release collar.

14. In a duplicating machine, the combination of claim 13 in which said bumper means is adjustable to vary the extent of said rotatable overrun.

15. In a duplicating machine, the combination of claim 10 in which said coil spring clutch member has interconnections at its ends with specific connected elements, namely, said release collar and said driven clutch member, and at least one of said interconnections comprises a tang at the end of the spring clutch member received in one of a series of circumferentially arranged slots in the corresponding connected element, to enable adjustment of the rotated position of said driven clutch member and drum relative to said release collar by optionally selecting one or another of said slots to receive said tang.

16. In a duplicating machine, the combination of claim 1 in which said drive means includes an electric motor;

said release collar has a cylindrical guide surface;

said detent means includes a recess in said cylindrical surface aligned with said stop arm;

said means including said copy sheet sensing means includes means responsive to the last copy sheet leaving the support to automatically press said stop arm against said cylindrical surface and then into said recess when continued rotation of said release collar registers said recess with the stop arm; and means to deactuate said electric motor in response to movement of said stop arm into said recess.

* * * * *

UNITED STATES PATENT OFFICE

CERTIFICATE OF CORRECTION

Patent No. 4,030,412 Dated June 21, 1977

Inventor(s) Edward M. Springer

It is certified that error appears in the above-identified patent and that said Letters Patent are hereby corrected as shown below:

Col. 2, Line 9, after "release" add -- collar --;

Col. 2, Line 17, change "collr" to -- collar --;

Col. 2, Line 25, change "collr" to -- collar --;

Col. 8, Line 16, change "not" to -- now --;

Col. 9, Line 39, change "beyohnd" to -- beyond --

Col. 12, Line 63, change "stop"(first occurrence) to -- start --

Signed and Sealed this

*Twenty-seventh* Day of *September 1977*

[SEAL]

*Attest:*

RUTH C. MASON
*Attesting Officer*

LUTRELLE F. PARKER
*Acting Commissioner of Patents and Trademarks*